US005971728A

United States Patent [19]

Konishi et al.

[11] Patent Number: 5,971,728

[45] Date of Patent: Oct. 26, 1999

[54] RESONATOR DEVICE FOR A HIGH-PRESSURE FUEL PUMP

[75] Inventors: Keiichi Konishi; Yoshihiko Oonishi, both of Tokyo, Japan

[73] Assignee: Mitsubishi Denki Kabushiki Kaisha, Tokyo, Japan

[21] Appl. No.: 08/968,468

[22] Filed: Nov. 12, 1997

[30] Foreign Application Priority Data

Jul. 11, 1997 [JP] Japan ..... 9-186479

[51] Int. Cl.[6] ..... F04B 11/00

[52] U.S. Cl. ..... 417/540; 417/312; 123/184.57

[58] Field of Search ..... 417/312, 540; 123/184.57

[56] References Cited

U.S. PATENT DOCUMENTS 4,444,013 4/1984 Inoue et al. ..... 60/605.1
4,539,947 9/1985 Sawada et al. ..... 123/184.57
5,040,495 8/1991 Harada et al. ..... 123/184.57
5,572,966 11/1996 Doddy et al. ..... 123/184.57

FOREIGN PATENT DOCUMENTS 5-231181 9/1993 Japan .
7-127446 5/1995 Japan .

*Primary Examiner*—Charles G. Freay
*Assistant Examiner*—Robert Z. Evora
*Attorney, Agent, or Firm*—Sughrue, Mion, Zinn, Macpeak & Seas, PLLC

[57] ABSTRACT

A resonator device for a high-pressure fuel pump, comprising a casing having a fuel passage formed therein, a cover arranged to the casing, and a cap attached between the casing and the cover, the cap providing a fuel passage chamber together with the fuel passage formed in the casing and a volume chamber together with the cover, the cap having an orifice formed therein to communicate between the volume chamber and the fuel passage chamber, wherein the cap has an outer diameter on a side of the fuel passage chamber set smaller than an outer diameter on a side of the volume chamber.

4 Claims, 9 Drawing Sheets

RESONATOR DEVICE FOR A HIGH-PRESSURE FUEL PUMP

BACKGROUND OF THE INVENTION

1. Field of the Invention

The present invention relates to improvements in a resonator device for a high-pressure fuel pump.

2. Background of the Invention

In FIG. 6, there is shown a sectional view of a conventional resonator device. In FIG. 6, reference numeral 1 designates a high-pressure fuel pump which is attached to an engine wherein injection is made in a cylinder. Reference numeral 18 designates a casing of the high-pressure fuel pump, and which has a storing recess 18*d* formed therein. Reference numeral 22 designates a passage at a discharge side of the high-pressure fuel pump 1, which is formed in the casing. Reference numeral 29 designates a cover which is fixed to the casing 18 and formed in a lidded shape. Reference numeral 30 designates a cap which is fixed to the casing 18 between the casing 18 and the cover 29 by a bolt 31, which provides a fuel passage chamber 32 together with the storing recess 18*d* in the casing 18 and a volume chamber 33 together with the cover 29, and which has an orifice 30*b* formed therein to communicate between the fuel passage chamber 32 and the volume chamber 33. Reference numeral 30*a* designates a fixing portion of the cap 30 which is to be screwed with the bolt 31. Reference numeral 34 designates a sealing material which is arranged between the cap 30 and the casing 18. Reference numeral 35 designates another sealing material which is arranged between the cap 30 and the cover 29. Reference numeral 36 designates the resonator device constituted by these elements as a whole.

In the conventional device thus constructed, the high-pressure fuel pump 1 is driven to inject a fuel into the discharge side passage 22. The reciprocation of the piston in the high-pressure fuel pump 1 causes intake strokes and exhaust strokes to be repeated in the high-pressure fuel pump 1, generating pressure pulsations in the discharge side passage 22 forming a part of a fuel pipe.

In order to damp the pressure pulsations in the fuel in a predetermined frequency range, the fuel passage chamber 32 and the volume chamber 33 have been provided, and both chambers have been communicated together through the orifice 30*b* having a predetermined length and a predetermined diameter.

The frequency of the pressure pulsations which can be absorbed by the resonator device is defined as follows:

$$f = \frac{C}{2\pi}\sqrt{\frac{S}{l \cdot V}}$$

wherein f represents a frequency, c represents the speed of sound (in a liquid), s represents a cross-sectional area of the orifice 30*b*, l represents the length of the orifice 30*b*, and v represents the volume in the volume chamber 33.

In the conventional resonator device, the outer diameter ϕB of the cap 30 on a side of the fuel passage chamber 32 is the same as the outer diameter ϕA of the cap 30 on a side of the volume chamber 33.

When the pressure difference between the fuel passage chamber 32 and the volume chamber 33 is generated in alternately opposite directions in the conventional device, loads are applied to the cap 30 in alternately opposite directions accordingly.

Such a phenomenon will be described in reference to FIGS. 7–9.

In FIGS. 7–9, reference P1 represents a pressure which is generated on the cap on the side of the volume chamber 33, reference P2 represents a pressure which is generated on the cap on the side of the fuel passage chamber 32, reference F1 represents a load which is applied to the cap on the side of the volume chamber 33, and reference F2 represents a load which is applied to the cap on the side of the fuel passage chamber 32.

As shown in FIG. 9, the cap 30 has great loads alternately applied thereto, causing the cap 30 to be vibrated. The vibration of the cap 30 has created a problem in that the sealing materials 34 and 35 are worn.

SUMMARY OF THE INVENTION

It is an object of the present invention to solve the problem, and to provide a resonator device for a high-pressure fuel pump capable of preventing a cap from being vibrated by a simple structure.

According to a first aspect of the present invention, there is provided a resonator device for a high-pressure fuel pump which comprises a casing having a fuel passage formed therein, a cover arranged to the casing, and a cap attached between the casing and the cover, the cap providing a fuel passage chamber together with the fuel passage formed in the casing and a volume chamber together with the cover, the cap having an orifice formed therein to communicate between the volume chamber and the fuel passage chamber, wherein the cap has an outer diameter on a side of the fuel passage chamber set smaller than an outer diameter on a side of the volume chamber.

According to a second aspect of the present invention, the fuel passage formed in the casing is constituted by a discharge side fuel passage extending from the fuel pump.

According to a third aspect of the present invention, the orifice in the cap is formed with a hollow projection which communicates with the orifice.

According to a fourth aspect of the present invention, the hollow projection extends toward the fuel passage chamber.

In accordance with the first aspect of the present invention, the loads applied to the cap can be directed in a single direction to restrain the cap from being vibrated and also to restrain e.g. the sealing materials attached to the cap from being worn, offering an advantage in that the device can have improved durability.

In accordance with the second aspect of the present invention, the cap can be prevented from being vibrated in a more effective way, improving the durability of the device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5(*b*) is a sectional view showing an arrangement to be contrasted with the arrangement shown in FIG. 5(*a*);

DESCRIPTION OF THE PREFERRED EMBODIMENTS

Embodiment 1

Figure 1:
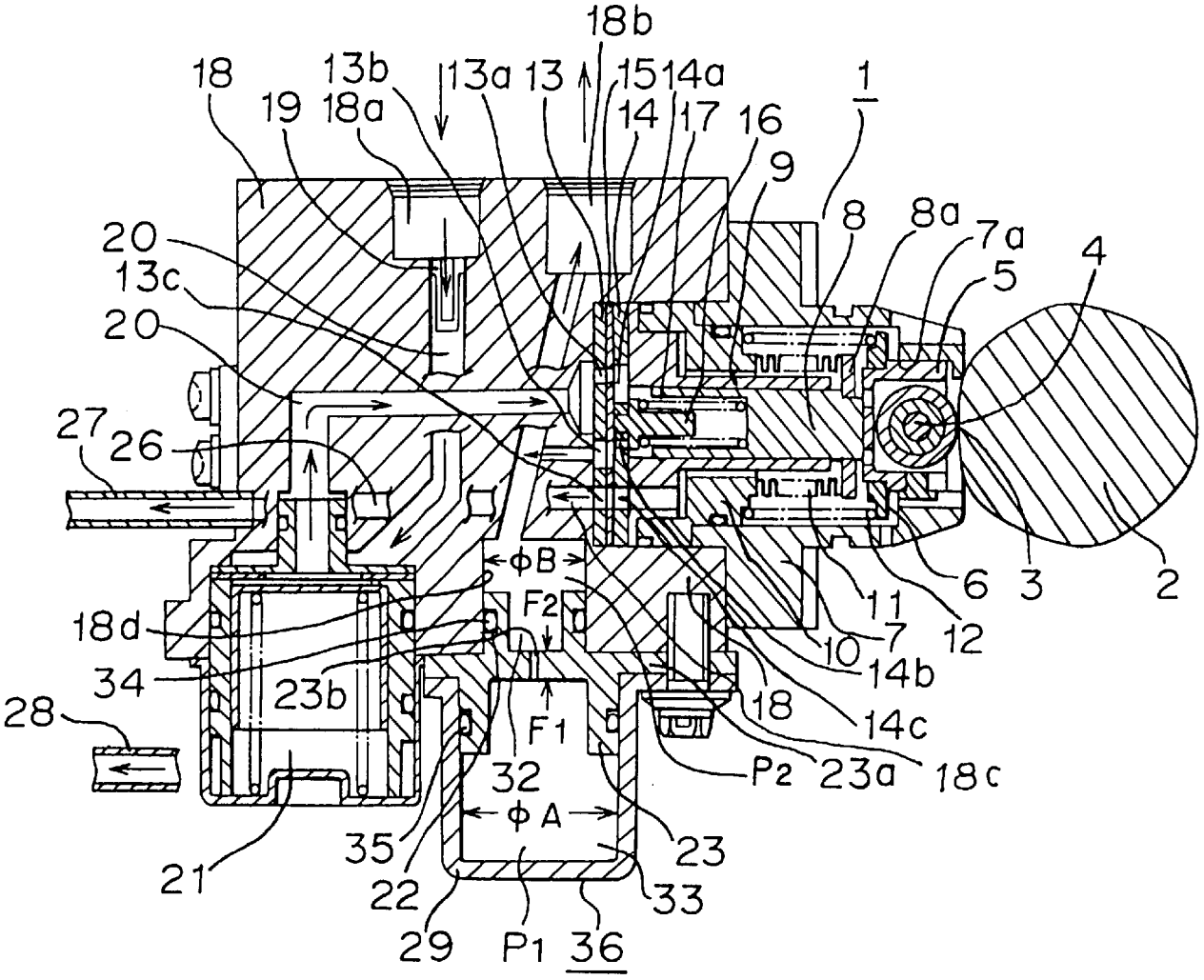
FIG. 1 is a sectional view showing a first embodiment according to the present invention.

In FIG. 1, there is shown a sectional view of a high-pressure fuel pump for an engine with injection made in a cylinder according to the present invention. In FIG. 1, reference numeral 1 designates the high-pressure fuel pump which is attachable to e.g. a housing of the engine (not shown). Reference numeral 2 designates a cam which is driven by the engine at a half of rotation thereof, and which has six projections formed on a circumferential surface thereof. Reference numeral 3 designates a cam roller which contacts with the cam. Reference numeral 4 designates a pin which rotatably supports the roller. Reference numeral 5 designates a tappet which rotatably supports the pin, and which is formed in a lidded cylindrical shape.

Reference numeral 6 designates a spring holder which is provided on the tappet. Reference numeral 7 designates a bracket which slidably supports the tappet 5, and which has an inner surface formed with a tappet sliding portion 7*a*. Reference numeral 8 designates a piston which is driven and reciprocated by the cam 2 through the tappet. Reference numeral 9 designates a sleeve which reciprocatively supports the piston and provides a pumping chamber as a fuel pressurization chamber. Reference numeral 10 designates a housing which supports the sleeve 9 so as to surround the sleeve. Reference numeral 11 designates a metallic bellows which has one end fixed to a holder 8*a* provided on the piston 8 and the other end fixed to the housing 10, and which stores a fuel leaked from between the piston 8 and the sleeve 9.

Reference numeral 12 designates a compression coil spring which extends between the spring holder 6 and the housing 10. Reference numeral 13 designates a plate A which is arranged on the sleeve 9, and which has an intake hole 13*a*, a discharge hole 13*b* and a return hole 13*c* formed therein. Reference numeral 14 designates a plate B which is arranged to sandwich a reed valve 15 between the plate A 13 and itself, and which has a intake hole 14*a*, a discharge hole 14*b* and a return hole 14*c* formed therein.

The reed valve 15 has a one way valve for intake, a one way valve for discharge and a through hole for return formed therein. Reference numeral 16 designates a spring guide which is connected to the plate B 14. Reference numeral 17 designates a compression coil spring which extends between the spring guide and the piston 8, and which constantly urges the piston 8 toward the tappet 5.

Reference numeral 18 designates a casing which has an intake port 18*a*, a discharge port 18*b* and a return hole 18*c* formed therein. Reference numeral 19 designates a filter which is arranged in the intake port 18*a*. Reference numeral 20 designates a passage on an intake side which is formed in the casing 18. Reference numeral 21 designates a piston damper which is in the intake side passage. Reference numeral 22 designates a passage on a discharge side which is formed in the casing 18. Reference numeral 23 designates a cap which is fixed to the casing 18 between the casing 18 and a cover 29 by a bolt 31, which provides a fuel passage chamber 32 together with a storing recess 18*d* formed in the casing 18 and a volume chamber 33 together with the cover 29, and which has an orifice 23*b* formed therein to communicate with the fuel passage chamber 32 and the volume chamber 33. The cap has an outer diameter ϕB set smaller than an outer diameter ϕA on a side of the volume chamber. Reference numeral 26 designates a return passage which returns the fuel stored in the bellows chamber to a fuel tank, and which is formed in the casing 18. Reference numeral 27 designates a return pipe which communicates with the return passage 26 in the casing 18 and forms a part of the return passage. Reference numeral 28 designates another return pipe which communicates with the piston damper 21.

In the first embodiment thus constructed, the cam 2 is rotated to reciprocate the piston 8 through the cam roller 3, the pin 4 and the tappet 5. When the piston 8 lowers, a fuel flows into the pumping chamber from the fuel intake port 18*a* through the filter 19, the intake passage 20, the piston damper 21, the intake passage 20, the intake hole 13*a* in the plate A 13, the intake valve in the reed valve 15 and the intake hole 14*a* in the plate B 14. When the piston 8 rises, the intake valve in the reed valve 15 is closed, and the discharge valve in the reed valve is opened to discharge the fuel in the pumping chamber through the discharge hole 13*b* in the plate A 13, the discharge passage 22, the resonator device 36, the discharge passage 22 and the discharge port 18*b*.

On the other hand, the fuel which has leaked from between the piston 8 and the sleeve 9 is prevented by the bellows 11 from leaking outside. The leaked fuel in the bellows 11 is returned to the fuel tank through a return hole in the sleeve 9, the return hole in the plate A 13, the return hole in the plate B 14, the return hole in the reed valve 15, the return passage 26 and the return pipe 27.

Although in the first embodiment, the reciprocation of the piston 8 in the high-pressure fuel pump 1 causes the high-pressure fuel pump 1 to repeatedly carry out intake strokes and exhaust strokes so as to produce pressure pulsations in the discharge side passage 22 forming the fuel pipe, the pressure pulsations can be reduced by the fuel passage chamber 32, the volume chamber 33 and the orifice 23*b*.

In accordance with the first embodiment, the outer diameter ϕB of the cap 23 on the side of the fuel passage chamber 32 is set smaller than the outer diameter ϕA of the cap on the side of the volume chamber 33. By such arrangement, loads are applied to the cap 23 so that loads F1 applied to the cap on the side of the volume chamber 33 is constantly greater than loads F2 applied to the cap on the side of the fuel passage chamber 32. As a result, the loads applied to the cap 23 can be directed to a single direction to restrain the cap 23 from being vibrated.

Such function will be explained in reference to FIGS. 2–4.

Figure 2:
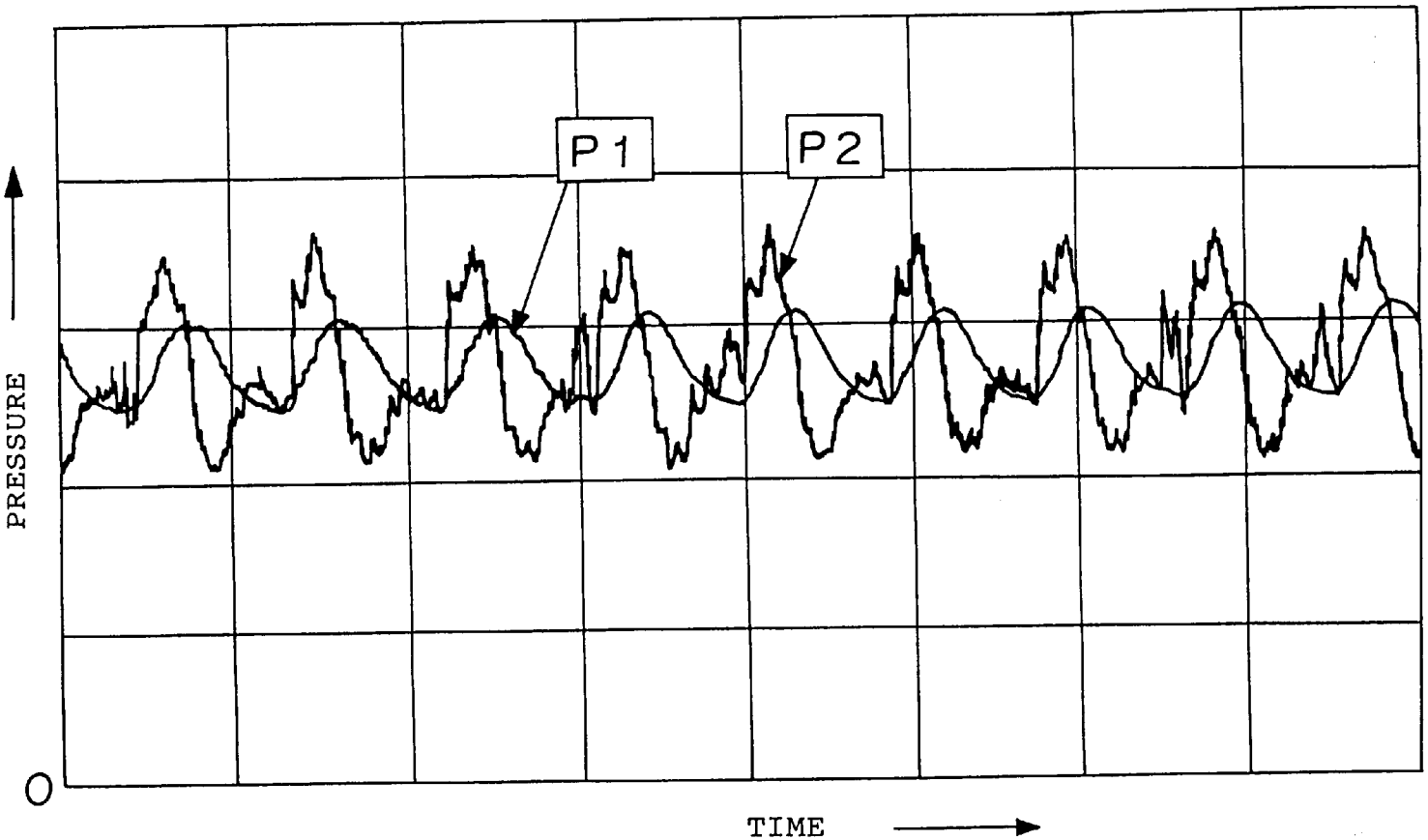
FIG. 2 is a characteristic diagram on variations in pressures with respect to the first embodiment.
Figure 3:
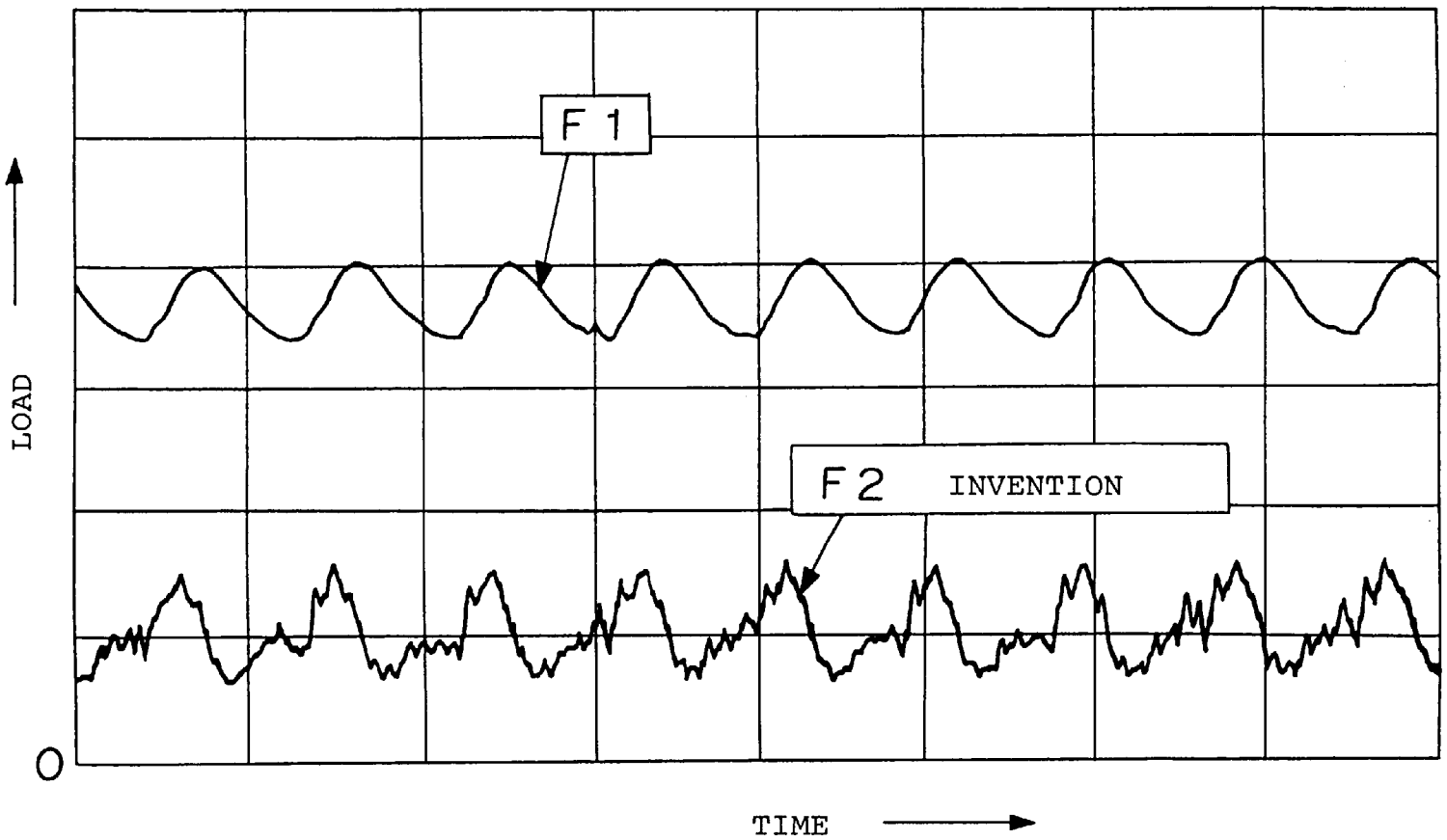
FIG. 3 is a characteristic diagram on variations in loads with respect to the first embodiment.
Figure 4:
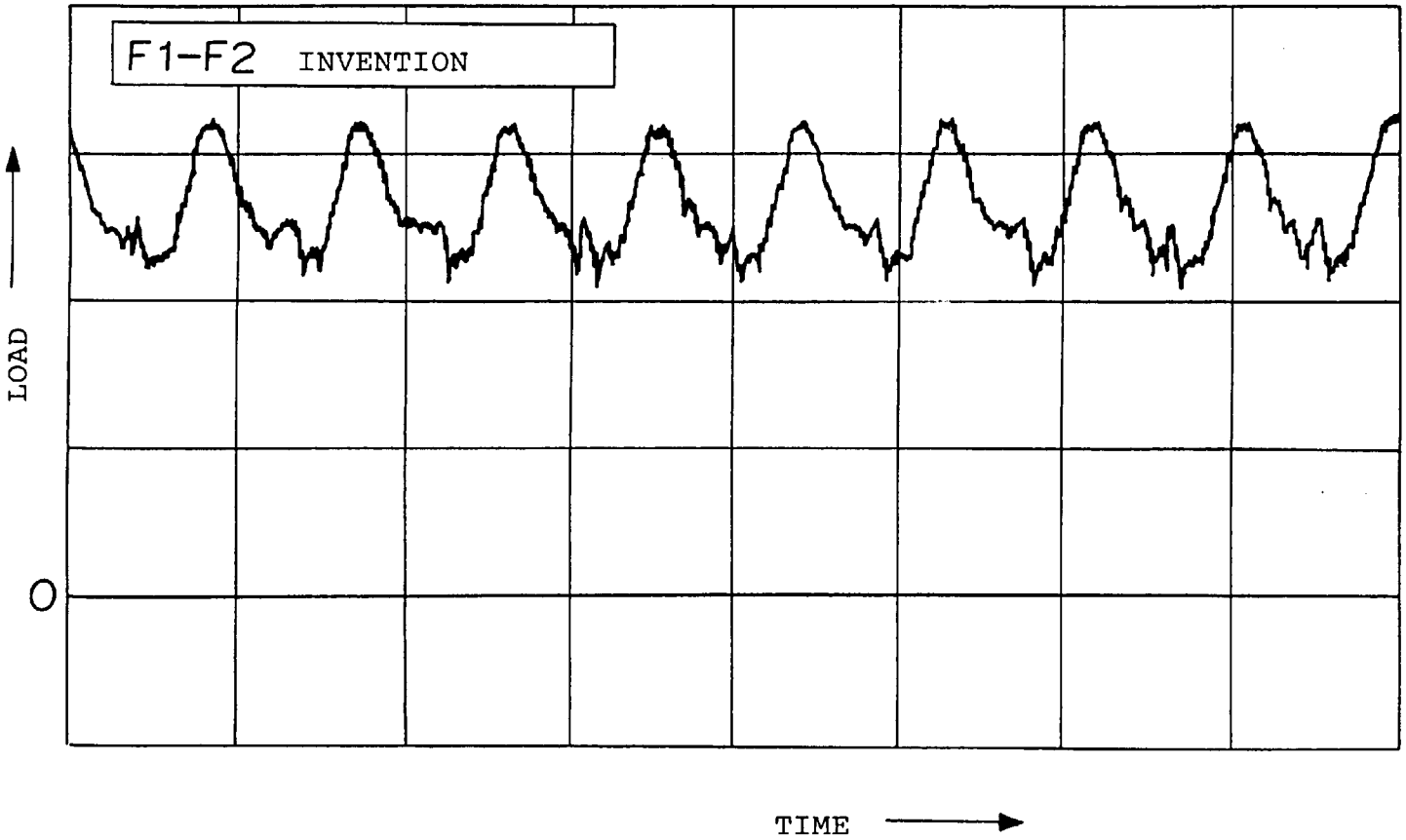
FIG. 4 is a characteristic diagram on variations in loads obtained by subtracting F2 from F1 with respect to the first embodiment.

In FIGS. 2–4, reference P1 represents a pressure which is generated in the volume chamber 33, reference P2 represents a pressure which is generated in the fuel passage chamber 32, reference F1 represents a load which is applied to the cap on the side of the volume chamber 33, and reference F2 represents a load which is applied to the cap on the side of the fuel passage chamber 32.

As shown in FIG. 4, the loads which are applied to the cap 23 by variations in pressure can be directed to a single direction to minimize the vibration of the cap 23, restraining sealing materials 34, 35 attached to the cap from being worn and improving durability.

Embodiment 2

Figure 5:
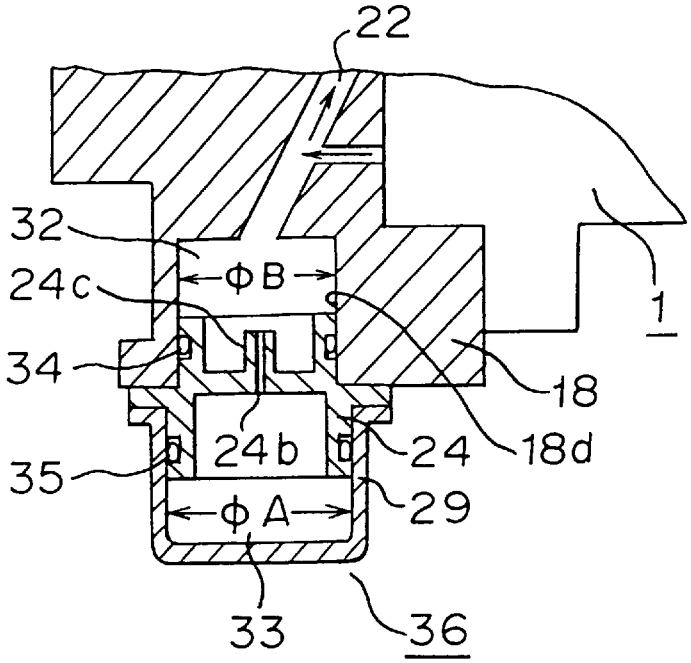
FIG. 5(*a*) is a sectional view showing essential parts of a second embodiment according to the present invention.
Figure 5:
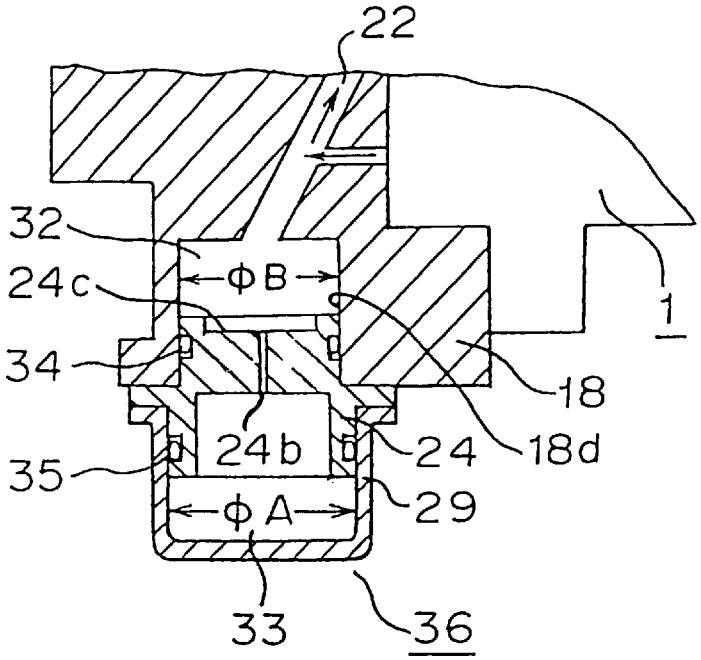
Figure 6:
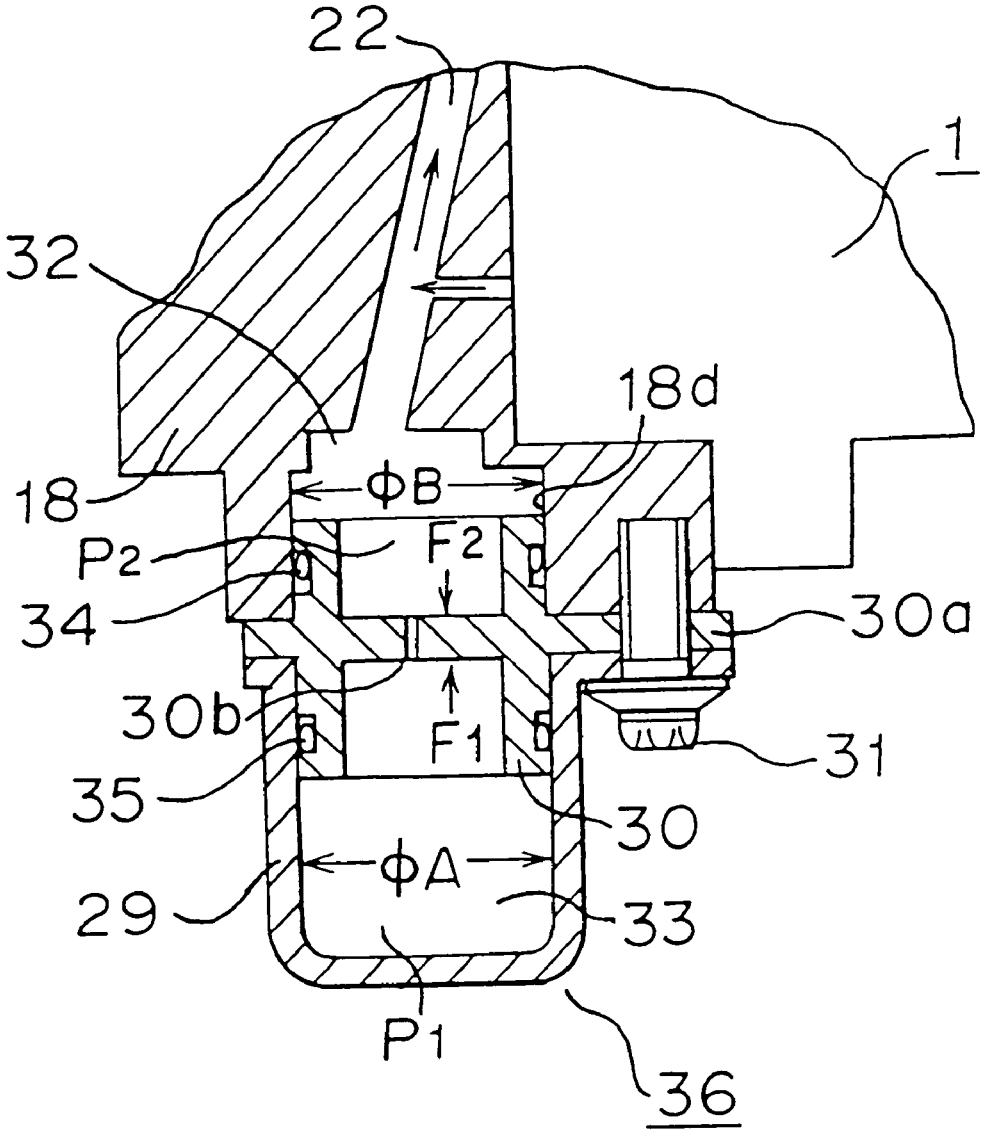
FIGURE 6 PRIOR ART
FIG. 6 is a sectional view showing essential parts of a conventional device.
Figure 7:
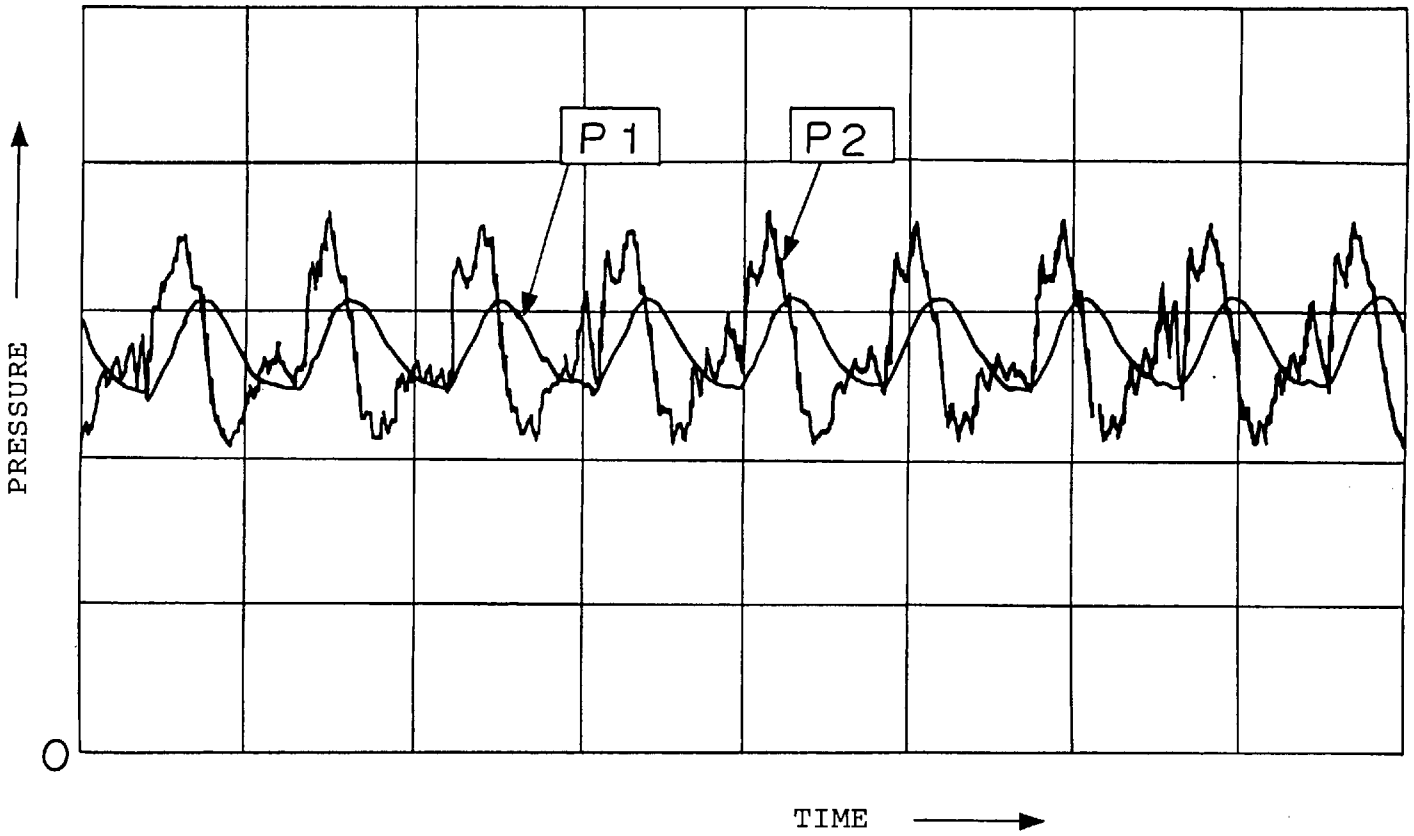
FIG. 7 is a characteristic diagram on variations in pressures in the conventional device.
Figure 8:
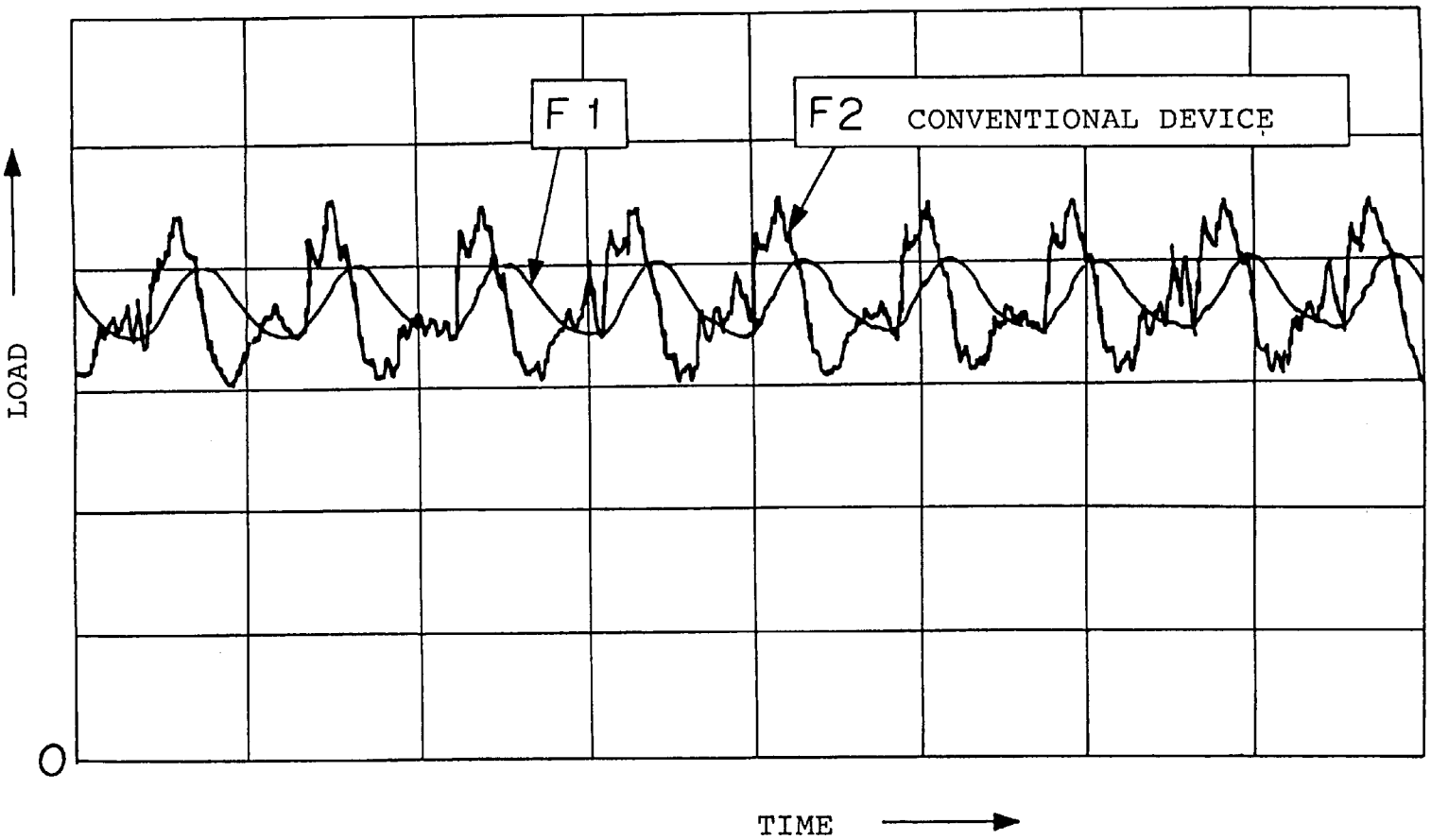
FIG. 8 is a characteristic diagram on variations on loads in the conventional device.
Figure 9:
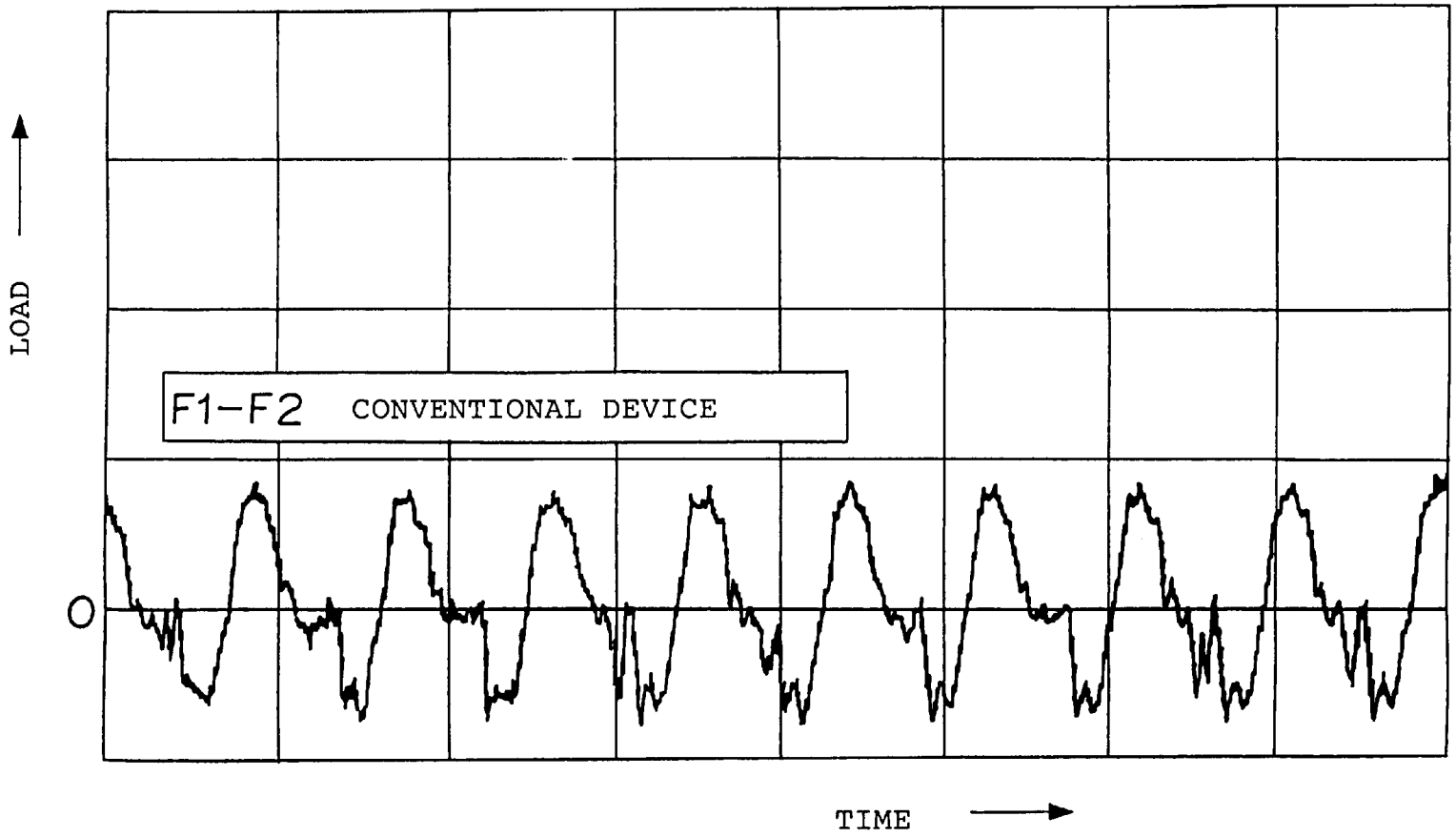
FIG. 9 is a characteristic diagram on variations in loads obtained by subtracting F2 from F1 in the conventional device.

In a second embodiment shown in FIG. 5(*a*), reference numeral 24 designates a cap which is fixed to the casing 18 between the casing and the cover 29 by the bolt 31, which provides the fuel passage chamber 32 together with the storing recess 18*d* in the casing 18 and the volume chamber 33 together with the cover 29, and which has an orifice 24*b* formed therein to communicate between the fuel passage chamber 32 and the volume chamber 33. Reference numeral 24*c* designates a projection which is arranged on the cap to extend the length of the orifice 24*b*.

In some cases, the orifice 24*b* is required to be lengthened in order to set the frequency of the resonator at a certain value. In such cases, the volume on the fuel passage side (ϕB side) is decreased as shown in FIG. 5(*b*), enlarging the pulsations on the fuel passage side. The enlarged pulsations are difficult to enjoy the effects offered by the resonator, which is disadvantageous.

When the orifice 24*b* is required to be lengthened in order to set the frequency of the resonator at a certain value, the arrangement shown in FIG. 5(*a*) can be adopted to enable the frequency of the resonator to be set at the certain value without a change in the pulsations on the fuel passage side, which makes it easier to obtain a pulsation decreasing effect.

Embodiment 3

Although in the first and second embodiments, the resonator device 36 is arranged in the discharge side passage 22 of the high-pressure fuel pump 1, the resonator device may be arranged in the intake side passage 20, offering similar functions and advantages.

Obviously, numerous modifications and variations of the present invention are possible in light of the above teachings. It is therefore to be understood that within the scope of the appended claims, the invention may be practiced otherwise than as specifically described herein.

What is claimed is:

1. A resonator device for a high-pressure fuel pump, comprising:

a casing having a fuel passage formed therein;

a cover arranged on the casing; and a cap attached between the casing and the cover, the cap providing a fuel passage chamber together with the fuel passage formed in the casing and a volume chamber together with the cover, the cap having an orifice formed therein to communicate between the volume chamber and the fuel passage chamber;

wherein the cap has an outer diameter on a side of the fuel passage chamber set smaller than an outer diameter on a side of the volume chamber.

2. A resonator device according to claim 1, wherein the fuel passage formed in the casing comprises a discharge side fuel passage extending from the fuel pump.

3. A resonator device according to claim 1, wherein the orifice in the cap is formed with a hollow projection which communicates with the orifice.

4. A resonator device according to claim 3, wherein the hollow projection extends toward the fuel passage chamber.

* * * * *